US005598716A

United States Patent [19]

Tanaka et al.

[11] Patent Number: 5,598,716

[45] Date of Patent: Feb. 4, 1997

[54] ICE THERMAL STORAGE REFRIGERATOR UNIT

[75] Inventors: Syouji Tanaka; Naoyuki Inoue; Kyoichi Katoh, all of Kanagawa-ken, Japan

[73] Assignee: Ebara Corporation, Tokyo, Japan

[21] Appl. No.: 501,788

[22] Filed: Jul. 13, 1995

[30] Foreign Application Priority Data

Jul. 18, 1994 [JP] Japan ..... 6-186808
Jun. 15, 1995 [JP] Japan ..... 7-171577

[51] Int. Cl.[6] ..... F25D 17/02

[52] U.S. Cl. ..... 62/185; 62/434

[58] Field of Search ..... 62/59, 430, 434, 62/180, 185, 201

[56] References Cited

U.S. PATENT DOCUMENTS

| | | | |
|---|---|---|---|
| 2,512,576 | 6/1950 | Cross | 62/59 |
| 4,294,078 | 10/1981 | MacCracken | 62/59 |
| 4,403,645 | 9/1983 | MacCracken | 165/10 |
| 4,509,344 | 4/1985 | Ludwigsen et al. | 62/76 |
| 4,513,574 | 4/1985 | Humpheys et al. | 62/59 |
| 4,823,556 | 4/1989 | Chestnut | 62/139 |
| 4,850,201 | 7/1989 | Oswalt et al. | 62/185 |
| 5,054,298 | 10/1991 | MacCracken | 62/434 |

FOREIGN PATENT DOCUMENTS

| | | | |
|---|---|---|---|
| 1-20334 | 4/1989 | Japan . | |
| 2-93234 | 4/1990 | Japan | 62/201 |
| 2-309141 | 12/1990 | Japan . | |

OTHER PUBLICATIONS

Japanese Patent Public Disclosure No. 2–309141 "The method for calculating heat quantity is similar" (Abstract).
Japanese Patent Public Disclosure No. 2–306064 "The method of taking out the accumulated heat quantity is similar" (Abstract).

*Primary Examiner*—William Doerrler
*Attorney, Agent, or Firm*—Armstrong, Westerman, Hattori, McLeland & Naughton

[57] ABSTRACT

An ice thermal storage refrigerator unit includes a brine path consisting essentially of a refrigerator, an ice thermal storage tank, a water heat exchanger, a brine pump, and control valves, which are connected by piping, and a cold water path consisting essentially of the water heat exchanger, a cooling load, and a cold water pump, which are connected by piping, so that brine is cooled in the refrigerator, and water in the ice thermal storage tank is frozen by the brine, thereby storing heat, and when heat is to be discharged, the brine is cooled by heat of fusion of the ice in the ice thermal storage tank, and the brine is introduced into the water heat exchanger to cool cold water, thereby taking out a cooling capacity. The ice thermal storage refrigerator unit further includes apparatus for detecting a quantity of stored heat remaining in the ice thermal storage tank and apparatus for detecting a quantity of heat discharged from the ice thermal storage tank in order to calculate an allowable discharging heat quantity from the quantity of stored heat remaining in the ice thermal storage tank, thereby providing an energy-saving and low-cost ice thermal storage refrigerator unit which enables a thermal storage tank to be effectively used to the full extent by adding only a simple measuring instrument.

14 Claims, 6 Drawing Sheets

ICE THERMAL STORAGE REFRIGERATOR UNIT

BACKGROUND OF THE INVENTION

1. Field of the Art

The present invention relates to an ice thermal storage refrigerator unit and, more particularly, to an ice thermal storage refrigerator unit which may be used in an air conditioning facility for an ordinary building, or the like.

2. Prior Art

An ice thermal storage refrigerator unit has been developed as a cooling system that utilizes the midnight service of electricity, which is economical, and it has been used as an energy-saving and space-saving building cooling system.

A typical ice thermal storage refrigerator unit includes a brine path consisting of a refrigerator, an ice thermal storage tank, a water heat exchanger, a brine pump, and control valves, which are connected by piping, and a cold water path consisting of the water heat exchanger, a cooling load, and a cold water pump, which are connected by piping. Brine is cooled in the refrigerator, and used to freeze water in the ice thermal storage tank, thereby storing heat (in this case negative) in the ice thermal storage tank. When heat is to be discharged, the brine is cooled by means of fusion heat of the ice contained in the ice thermal storage tank, and the brine is introduced into the water heat exchanger to cool cold water, thereby supplying cooling power to the cooling load.

In a conventional ice thermal storage refrigerator unit, however, load measurement and load prediction have heretofore been made by using advanced computer technology, and complicated and costly control has been required.

Further, in a conventional refrigerator unit, a refrigerator is mainly used and a thermal storage tank is only used as an auxiliary device. Accordingly, the cooling capacity of the thermal storage tank is not used to the fullest extent, which necessitates costly operation of the refrigerator during daytime and increases machine capacity.

Therefore, an object of the present invention is to solve the above-described problems and to provide an energy-saving and low-cost ice thermal storage refrigerator unit which enables a thermal storage tank to be effectively used to the fullest extent with only the use of a simple measuring instrument.

SUMMARY OF THE INVENTION

To solve the above-described problems, the present invention provides an ice thermal storage refrigerator unit having a brine path including a refrigerator, an ice thermal storage tank, a water heat exchanger, a brine pump, and control valves, which are connected by piping, and a cold water path including the water heat exchanger, a cooling load, and a cold water pump, which are connected by piping, so that brine is cooled in the refrigerator, and water in the ice thermal storage tank is frozen by the brine, thereby storing heat, and when heat is to be discharged, the brine is cooled by means fusion heat of the ice in the ice thermal storage tank, and the brine is introduced into the water heat exchanger to cool cold water, thereby taking out a cooling capacity, wherein the ice thermal storage refrigerator unit includes means for detecting a quantity of stored heat remaining in the ice thermal storage tank and for detecting a quantity of heat discharged from the ice thermal storage tank in order to calculate an allowable discharging heat quantity from the quantity of stored heat remaining in the ice thermal storage tank.

In the present invention, the allowable discharging heat quantity may be determined by calculating an average value for a predetermined period of time, or by weighing a value of the allowable discharging heat quantity according to time.

Further, in the above-described ice thermal storage refrigerator unit, the means for detecting a quantity of stored heat remaining in the ice thermal storage tank may be a water level indicator which is provided in the ice thermal storage tank, or a calorimeter which is provided in the brine path, or a combination of temperature sensors which are provided in the brine path at the upstream and downstream sides, respectively, of the ice thermal storage tank, and a flowmeter which is provided in the brine path, and the means for detecting a quantity of heat discharged from the ice thermal storage tank may be a calorimeter which is provided in the brine path, or a combination of temperature sensors which are provided in the brine path at the upstream and downstream sides, respectively, of the ice thermal storage tank, and a flowmeter which is provided in the brine path.

In the ice thermal storage refrigerator unit, the quantity of heat that has been stored in the ice thermal storage tank must be treated according to the load so that the following two requirements are met: ① the quantity of stored heat should be used up as much as possible from the viewpoint of effective use of the midnight service of electricity; and ② only the deficiency in the quantity of heat should be supplemented by a refrigerator during the day with a view to reducing the machine capacity.

That is, when the load is small, if the system is run by operating mainly the refrigerator, an excess heat quantity remains in the ice thermal storage tank. On the other hand, if the heat quantity in the ice thermal storage tank is overused when the load is large, it becomes impossible to cope with peak-load running. The critical point of the control is to operate the system so that no such problems occur. Therefore, the conventional practice is to perform load prediction and load calculation by making use of an advanced computer, and hence such control has heretofore been excessively complicated and costly.

In the present invention, there is provided means for detecting a quantity of stored heat remaining in the ice thermal storage tank and for detecting a quantity of heat discharged from the ice thermal storage tank, thereby enabling an optimum allowable discharging heat quantity to be determined on the basis of the detected values. For example, as shown in FIG. 2, a quantity of heat to be discharged is determined so that a deficiency in the quantity of heat is supplemented by appropriately distributing and using the heat quantity stored in the ice thermal storage tank in a time zone during the day when the cooling load is large. By doing so, the machine capacity can be reduced, and it is also possible to use up heat quantity stored in the ice thermal storage tank.

The above and other objects, features and advantages of the present invention will become more apparent from the following description when taken in conjunction with the accompanying drawings in which preferred embodiments of the present invention are shown by way of illustrative examples.

PREFERRED EMBODIMENTS OF THE INVENTION

The present invention will be described below more specifically with reference to the accompanying drawings. However, the present invention is not necessarily limited to these embodiments.

Figure 1:
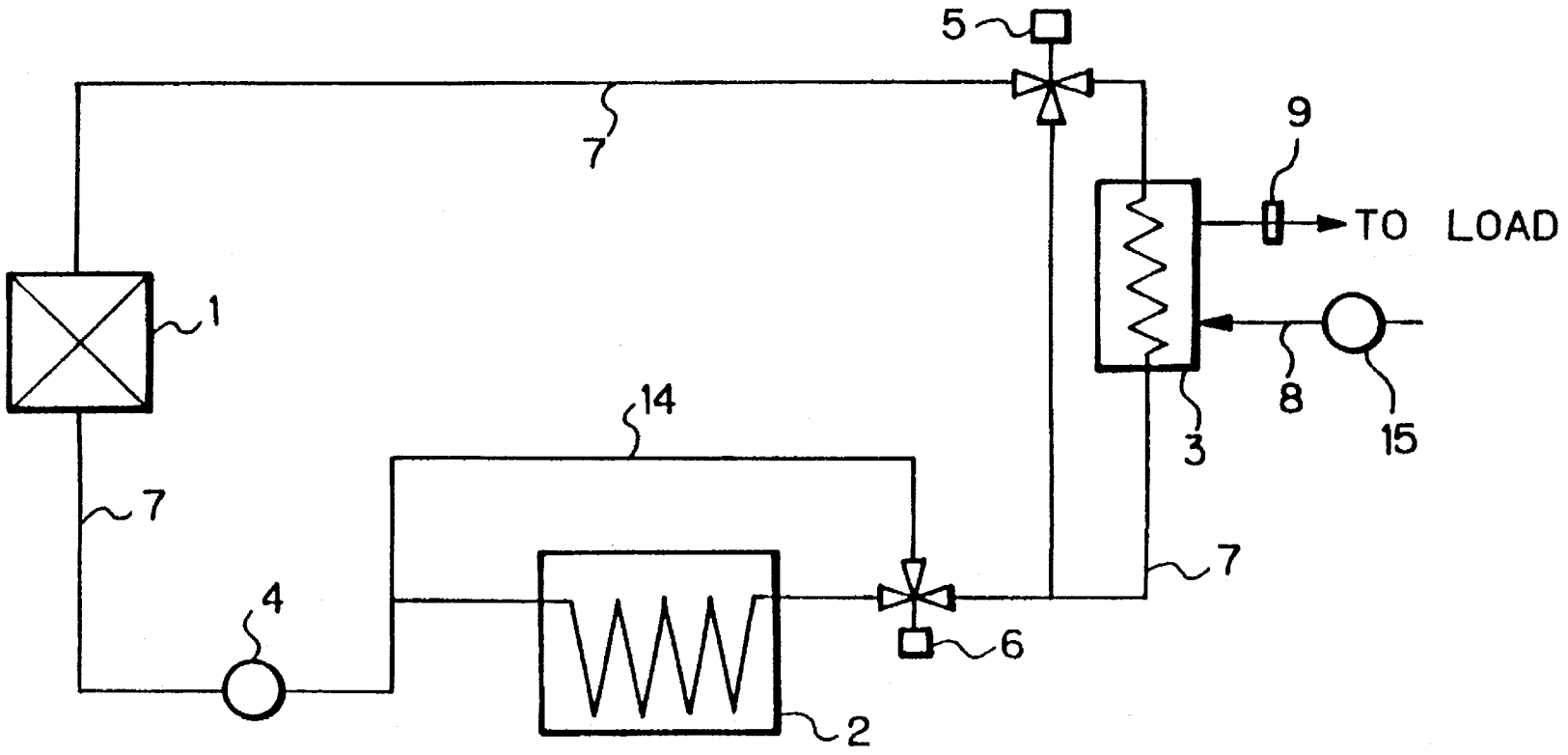
FIG. 1 is a brine flow diagram for explaining the ice thermal storage refrigerator unit of the present invention.
Figure 2:
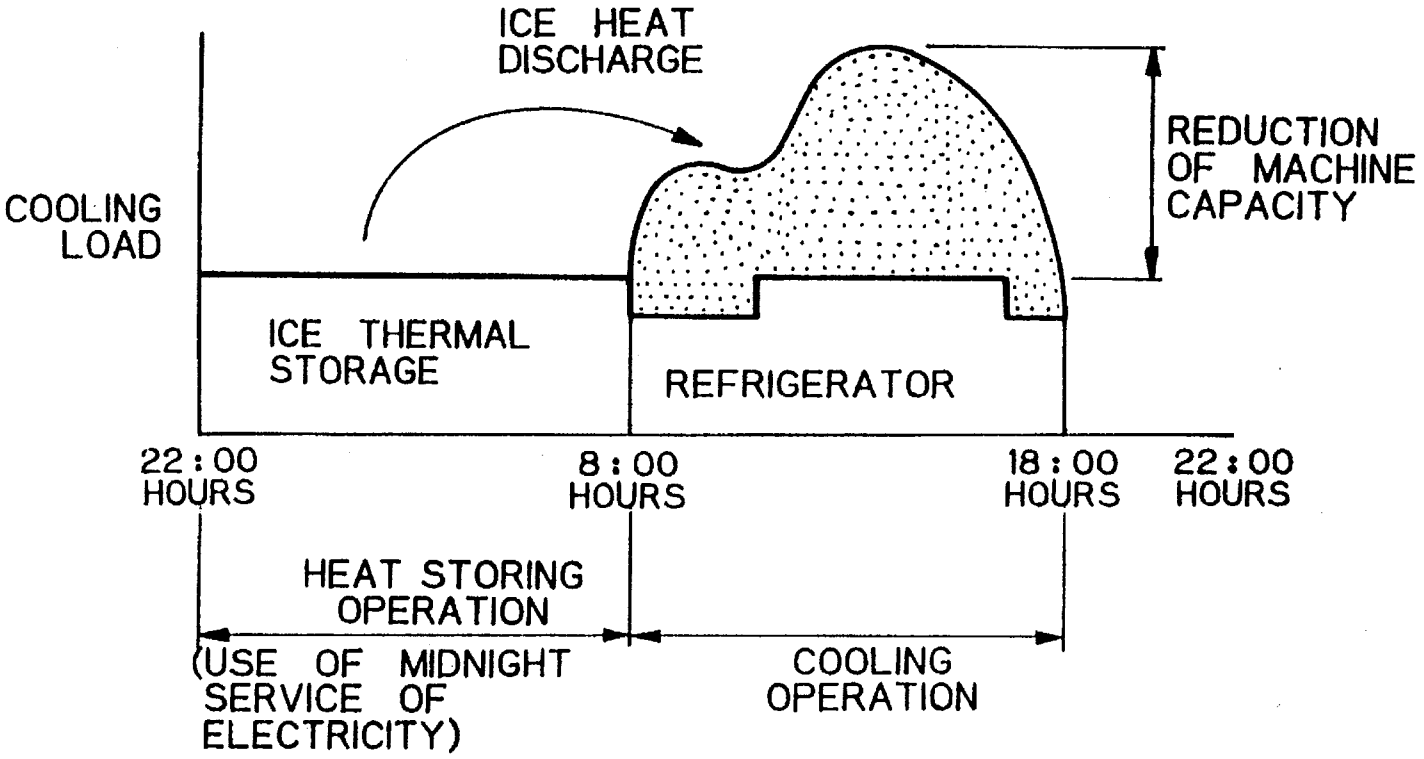
FIG. 2 shows an example of the operation of the ice thermal storage refrigerator unit.

FIG. 1 is a flow diagram for explaining the ice thermal storage refrigerator unit of the present invention.

In FIG. 1, reference numeral 1 denotes a refrigerator, 2 an ice thermal storage tank, 3 a water heat exchanger, 4 a brine pump, 5 a control valve, 6 a control valve, 7 brine piping, 8 cold water piping, 9 a temperature sensor attached to the cold water piping 8, 14 a bypass circuit and 15 a cold water pump.

In this ice thermal storage refrigerator unit, during a heat storing operation, the refrigerator 1 produces cold brine, for example, at −5° C. The brine is allowed to bypass the water heat exchanger 3 by the control valve 5, and the entire brine is introduced into the ice thermal storage tank 2 through the control valve 6, In the ice thermal storage tank 2, the brine freezes water.

As the result of extracting heat from the water in the ice thermal storage tank 2, the brine rises in temperature to about −2° C., for example, and then comes out of the ice thermal storage tank 2 and returns to the refrigerator 1, thus completing one cycle. The reason why the water heat exchanger 3 is bypassed by the control valve 5 is to prevent cold water in the heat exchanger 3 from freezing, which might otherwise cause the water heat exchanger to be damaged.

During a heat discharging operation (cooling operation), brine is cooled by using the fusion heat of the ice in the ice thermal storage tank 2, and the system is controlled so that the cold water temperature at the water heat exchanger outlet 9 becomes a predetermined temperature (e.g., 7° C.).

More specifically, when the temperature of cold water at 9 is higher than a target temperature, the amount of brine to be introduced into the water heat exchanger 3 is increased by the control valve 5, thereby increasing the output for cooling. Conversely, when the cold water temperature at 9 is lower than a target temperature, the amount of brine to be introduced into the water heat exchanger 3 is reduced by the control valve 5, thereby reducing the output for cooling. In this way, the cold water temperature control is effected.

In a case where a demand for the cooling load cannot be satisfied by only the heat of fusion from the ice thermal storage tank, then, the refrigerator 1 is operated, thereby performing cooling by both the ice thermal storage tank and the refrigerator. Judgment as to when the refrigerator 1 should be started to operate is made, for example, by detecting whether the brine temperature has exceeded a predetermined temperature, or the cold water temperature has exceeded a predetermined temperature.

Next, the relationship between the stored heat quantity remaining in the ice thermal storage tank 2 and the allowable discharging heat quantity will be explained.

Figure 3:
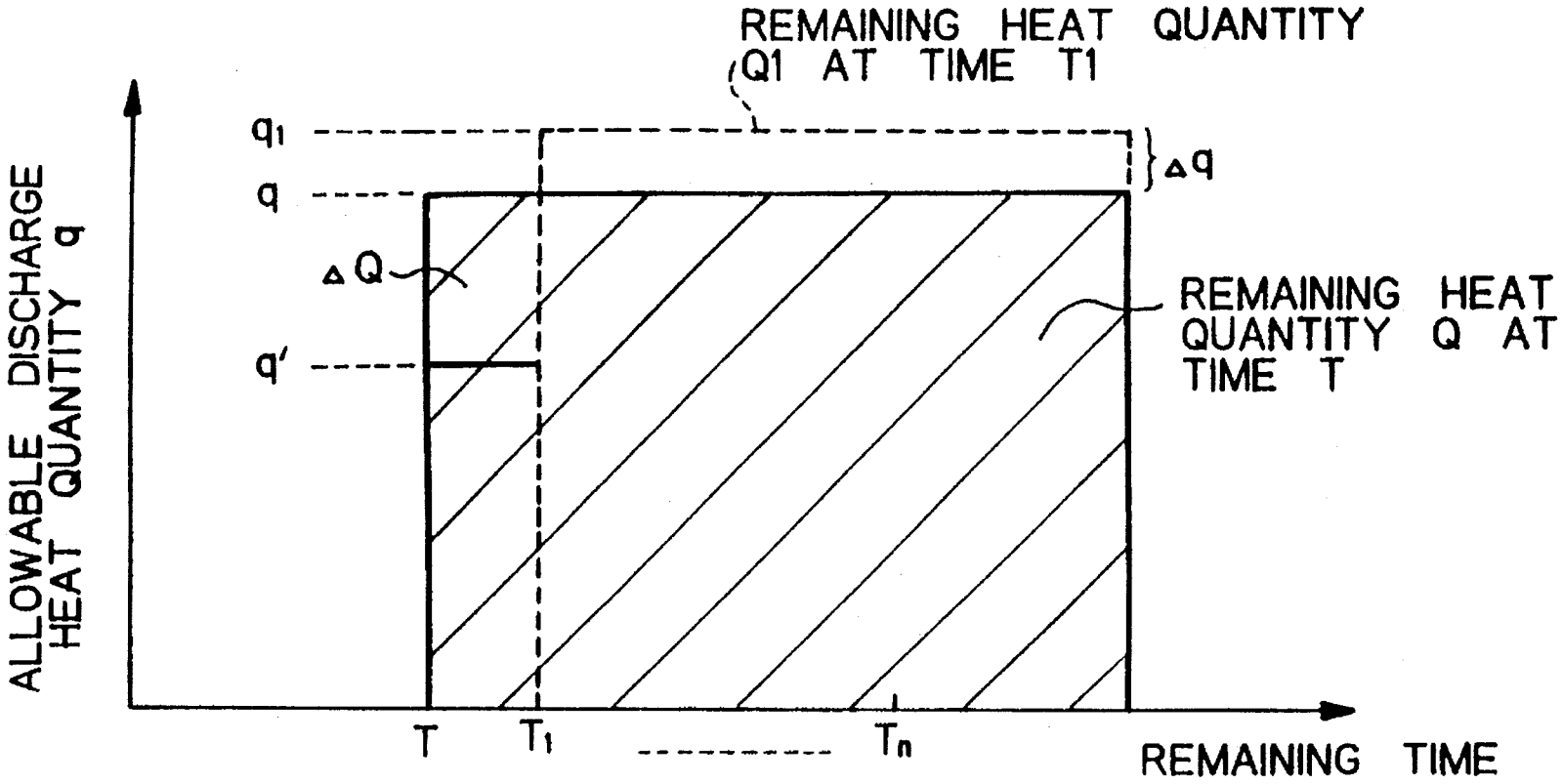
FIG. 3 is a graph showing the relationship between the remaining stored heat quantity and the allowable discharging heat quantity.

FIG. 3 is a graph in which the remaining air-conditioning time is plotted along the abscissa axis, and the allowable discharging heat quantity is plotted along the ordinate axis. Assuming that the remaining stored heat quantity for the remaining time T (h) at certain time is Q (kcal) (hatched area), the following relationship holds:

$$q=Q/T\ (kcal/h) \qquad \text{Eq. 1}$$

Accordingly, an allowable radiating heat quantity (q) from the ice thermal storage tank is determined.

Thus, when the load is so small that the ice thermal storage tank alone can supply all the heat quantity required, the refrigerator need not be operated. When the load is large, the refrigerator is operated so as to make up for a deficiency of heat quantity. Accordingly, there is no possibility that heat quantity in the ice thermal storage tank will be overused.

When the remaining stored heat quantity for the remaining time $T_1$ (h) is $Q_1$, the allowable radiating heat quantity $q_1$ for the remaining time $T_1$ is given by:

$$q_1=Q_1/T_1 \qquad \text{Eq. 2}$$

In this case, if heat quantity $\Delta Q$ is left unused in the previous time (i.e., the difference between the allowable discharging heat quantity q and the actual discharged heat quantity q') it can be added to the subsequent allowable radiating heat quantity in an average manner as $\Delta q$.

The allowable discharging heat quantity may be always continuously determined; but it may also be approximately calculated at time intervals of the order of from 30 minutes to 1 hour.

In a case where the allowable discharging heat quantity is approximately calculated at time intervals of about 1 hour, a quantity of heat left unused in the previous hour may be added to the allowable discharging heat quantity for the subsequent hour. That is, the arrangement may be such that an allowable discharged heat quantity q for each hour has previously been determined, and a quantity of heat left unused in the previous hour is added to the allowable discharging heat quantity for the subsequent hour. For example, the quantity of heat stored at the time of completion of storage of heat or the stored heat quantity at the time of starting a heat discharging operation (Q) is distributed to the air conditioning time T, thereby previously giving an allowable discharging heat quantity $q_n$ to each hour, and a quantity of heat left unused in the previous hour, i.e., $\Delta q_{n-1}=q_{n-1}-q'_{n-1}$($q_{n-1}$: the allowable discharging heat quantity for the previous hour; $q'_{n-1}$: the discharging heat quantity in the previous hour), is added to the allowable discharging heat quantity $q_n$ for the subsequent hour. Thus, $q_n+\Delta q_{n-1}$ is determined as a new allowable discharging heat quantity instead of $q_n$.

Figure 4:
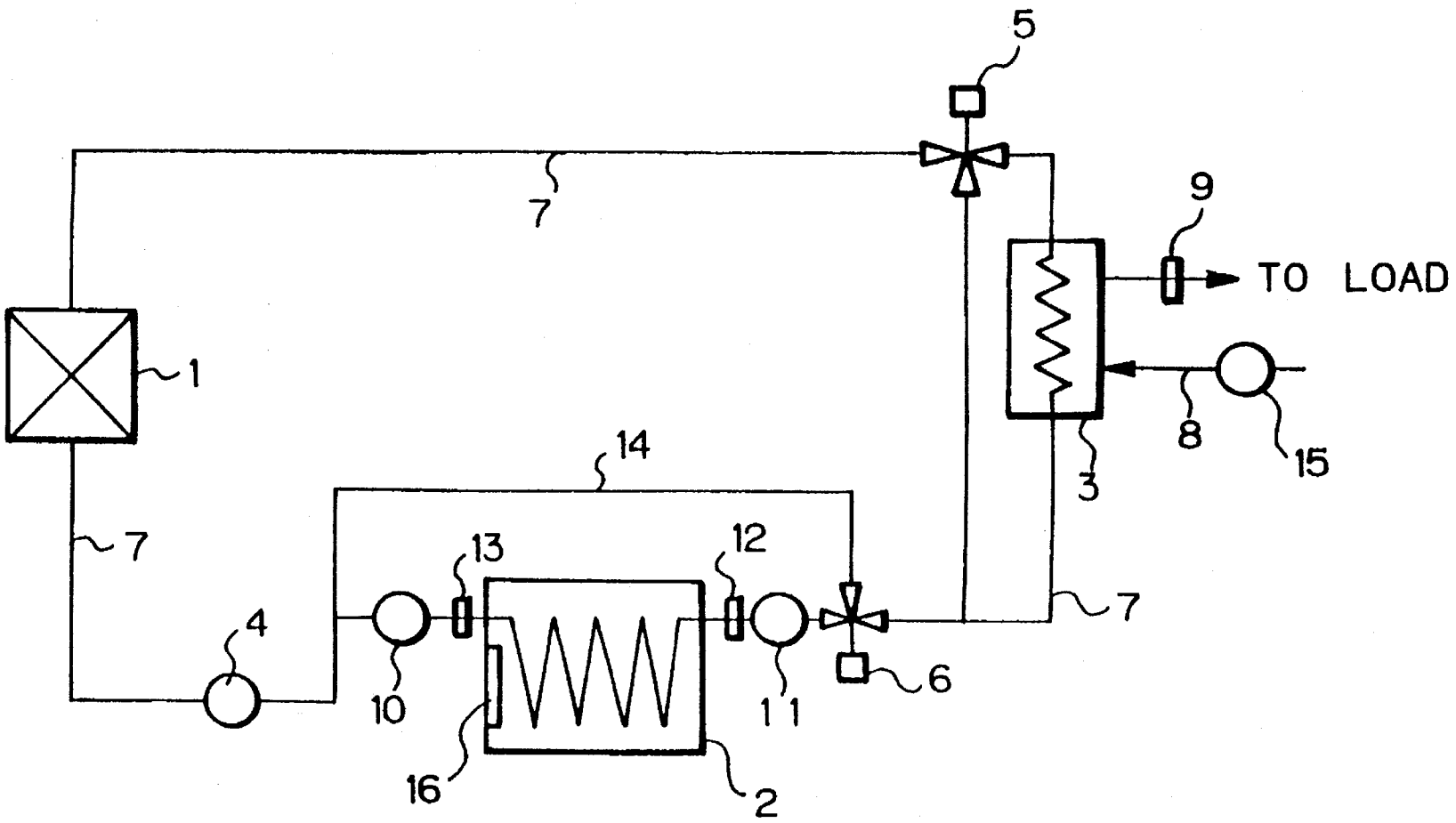
FIG. 4 is a brine flow diagram showing one example of the ice thermal storage refrigerator unit according to the present invention.

FIG. 4 is a flow diagram showing one example of the ice thermal storage refrigerator unit according to the present invention.

In FIG. 4, the same reference numerals as those in FIG. 1 denote the same elements. In FIG. 4, a calorimeter 10 is provided in the line of the ice thermal storage tank, thereby enabling the quantity of discharged heat to be measured. It is also possible to calculate a discharged heat quantity from the product of the temperature difference between the upstream and downstream ends of the ice thermal storage tank and the flow rate by providing temperature sensors 12 and 13 and a flowmeter 11.

Figure 5:
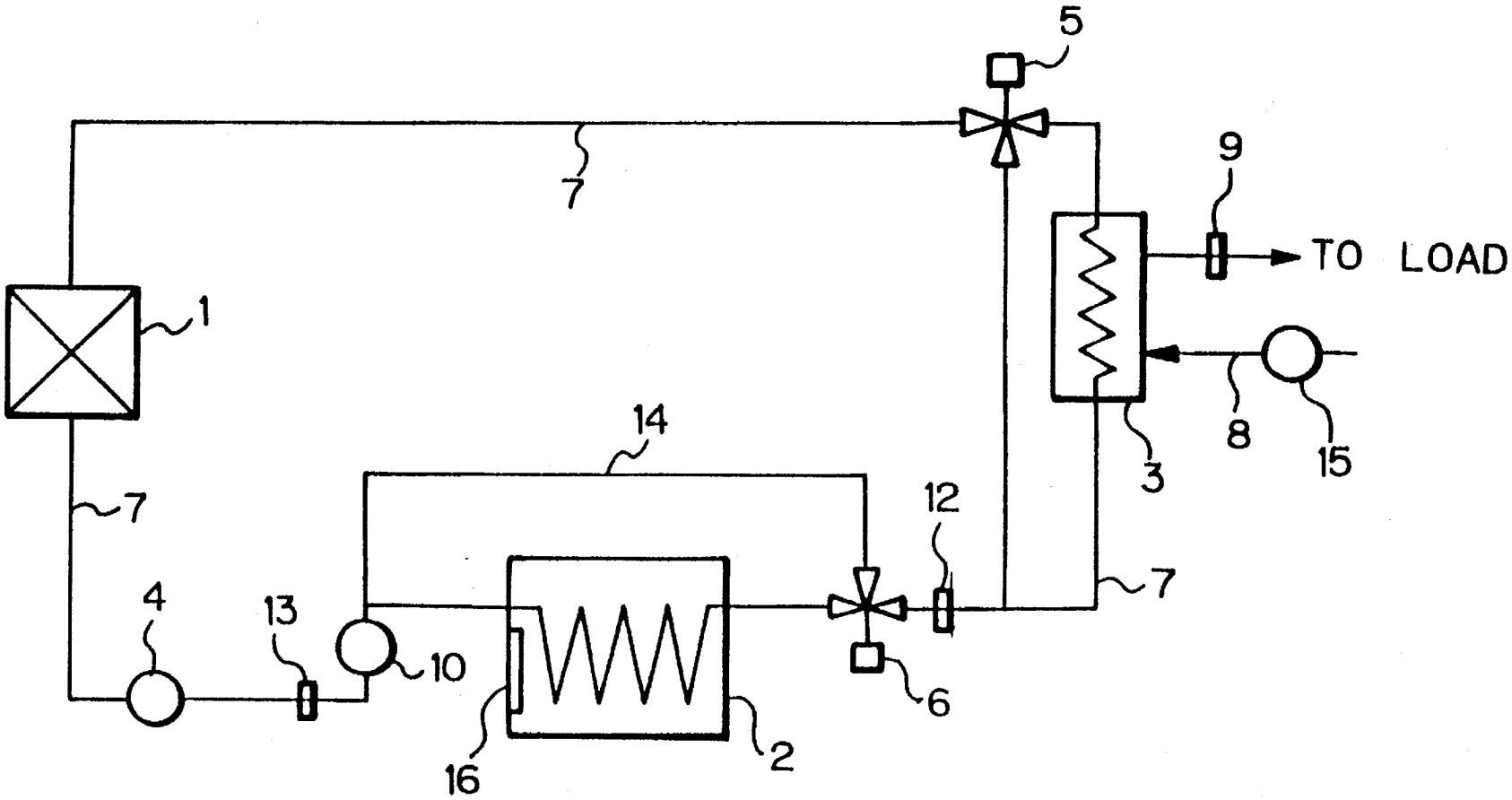
FIG. 5 is a brine flow diagram showing another example of the ice thermal storage refrigerator unit according to the present invention.

It should be noted that the temperature sensors 12 and 13 and the flowmeter 11 may be provided at the upstream and downstream sides of the ice thermal storage tank, including the bypass circuit 14, as shown in FIG. 5.

It should be noted that each of the three-way valves 5 and 6 in FIGS. 4 and 5 may be replaced by a couple of two-way valves (that is, a couple of two-way valves can substitute for a three-way valve).

In FIGS. 4 and 5, the amount of brine to be introduced into the ice thermal storage tank 2 is controlled by the control valve 6 so that the allowable discharging heat quantity and the discharged heat quantity coincide with each other.

More specifically, when the detected discharged heat quantity is smaller than the allowable discharging heat quantity, the amount of brine to be introduced into the ice thermal storage tank is increased by the control valve 6, thereby increasing the discharged heat quantity, whereas, when the detected discharged heat quantity is larger than the allowable discharging heat quantity, the amount of brine to be introduced into the ice thermal storage tank is reduced, thereby reducing the discharged heat quantity.

However, when the load is smaller than the allowable discharging heat quantity, even if the entire brine is introduced into the ice thermal storage tank, there is no substantial increase in the discharged heat quantity, resulting in a surplus of the allowable discharging heat quantity.

The fact that the control valve 6 is controlled so that the allowable discharging heat quantity and the discharged heat quantity coincide with each other means, in other words, that the control valve 6 is controlled so that the maximum discharged heat quantity within the allowable discharging heat quantity is realized.

When the cooling load is so large that the demand for the cooling load cannot be satisfied by only the allowable discharging heat quantity, the refrigerator 1 is operated, thereby performing cooling of the cooling load by both the ice thermal storage tank 2 and the refrigerator 1. Judgment as to when the refrigerator should be started to operate is made, for example, by detecting that the brine temperature has exceeded a predetermined temperature. On the other hand, when the cooling load is so small that the quantity of heat required therefor is less than the allowable discharging heat quantity, operation of the refrigerator 1 is suspended, and cooling is carried out by the ice thermal storage tank 2 alone. Judgment as to whether or not the refrigerator should be suspended is made, for example, by detecting that the brine temperature has become lower than a predetermined temperature.

When the load is large, all the allowable discharging heat quantity is used. However, when the load is so small that the discharged heat quantity is less than the allowable discharging heat quantity, the excess part of the allowable discharging heat quantity is added to the allowable discharging heat quantity for the subsequent hour.

Further, detection of the quantity of remaining stored heat may be approximately made on the basis of the water level in the ice thermal storage tank, for example. That is, as the quantity of stored heat remaining in the tank increases as a result of formation of ice, the water level rises. As the quantity of stored heat decreases as a result of discharge of heat, the water level falls.

It is, therefore, possible to judge a stored heat quantity by an amount of rise of the water level from a reference level 0 which is the level when there is no ice in the ice thermal storage tank. During the heat discharging operation, the quantity of stored heat remaining in the ice thermal storage tank at each particular time can be detected from the water level by a water level indicator 16.

It is also possible to calculate the quantity of remaining stored heat by determining the discharged heat quantity from the rated quantity of heat stored at the time of completion of storage of heat.

That is, the remaining stored heat quantity may be detected by subtracting the discharged heat quantity from the stored heat quantity $Q_0$ at the time of completion of storage of heat. As stated above, the discharged heat quantity can be measured by the calorimeter 10, or can be calculated from the product of the temperature difference detected by the temperature sensors 12 and 13 and the flow rate detected by the flowmeter 11 (flow rate×temperature difference).

In general, the air conditioning load is affected by the outside air, and hence a large load exists between about 11:00 and about 15:00. Therefore, the allowable discharging heat quantity q can be determined even more appropriately by weighing the calculated heat quantity according to each particular hour.

For example, if the proportion of the quantity of heat to be radiated is determined as follows:

| | |
|---|---|
| from 8:00 hours to 11:00 hours | coefficient $\alpha = 1$ |
| from 11:00 hours to 15:00 hours | coefficient $\alpha = 2$ |
| from 15:00 hours to 18:00 hours | coefficient $\alpha = 1$ |

then, it is possible to cope, even more appropriately, with the demand during the day, during which the cooling load is large. Since use of the electric power is at a peak in hours between 13:00 and 15:00 in particular, the proportion of the quantity of heat to be discharged may be determined as follows:

| | |
|---|---|
| from 8:00 hours to 11:00 hours | coefficient $\alpha = 1$ |
| from 11:00 hours to 13:00 hours | coefficient $\alpha = 2$ |
| from 13:00 hours to 15:00 hours | coefficient $\alpha = 3$ |
| from 15:00 hours to 18:00 hours | coefficient $\alpha = 1$ |

By weighing the calculated heat quantity as described above, the allowable discharging heat quantity can be determined so as to correspond to the load even more accurately. In addition, the refrigerator can be suspended during the period of time between 13:00 hours and 15:00 hours, depending on the capacity of the ice thermal storage tank.

Further, the allowable discharging heat quantity may also be given by previously allocating the stored heat quantity 100% to each hour, for example:

from 8:00 hours to 11:00 hours allowable discharging heat quantity 7.0%/h from 11:00 hours to 15:00 hours allowable discharging heat quantity 14.5%/h from 15:00 hours to 18:00 hours allowable discharging heat quantity 7.0%/h In this case, the quantity of heat left unused in the previous hour may be added to the allowable discharging heat quantity for the subsequent hour. Alternatively, the arrangement may be such that the quantity of heat left unused in the previous hour is equally divided by the number of hours of the remaining air conditioning time, and the result of the division is added to the allowable discharging heat quantity for each hour.

For example, in the above case, the quantity of heat left unused in the previous hour may be added to the allowable discharging heat quantity for the subsequent hour as follows: When only 5% of the stored heat quantity was used during the hour between 8:00 and 9:00, the allowable discharging heat quantity for the subsequent hour between 9:00 and 10:00 is determined to be 7+2%=9%.

Figure 6:
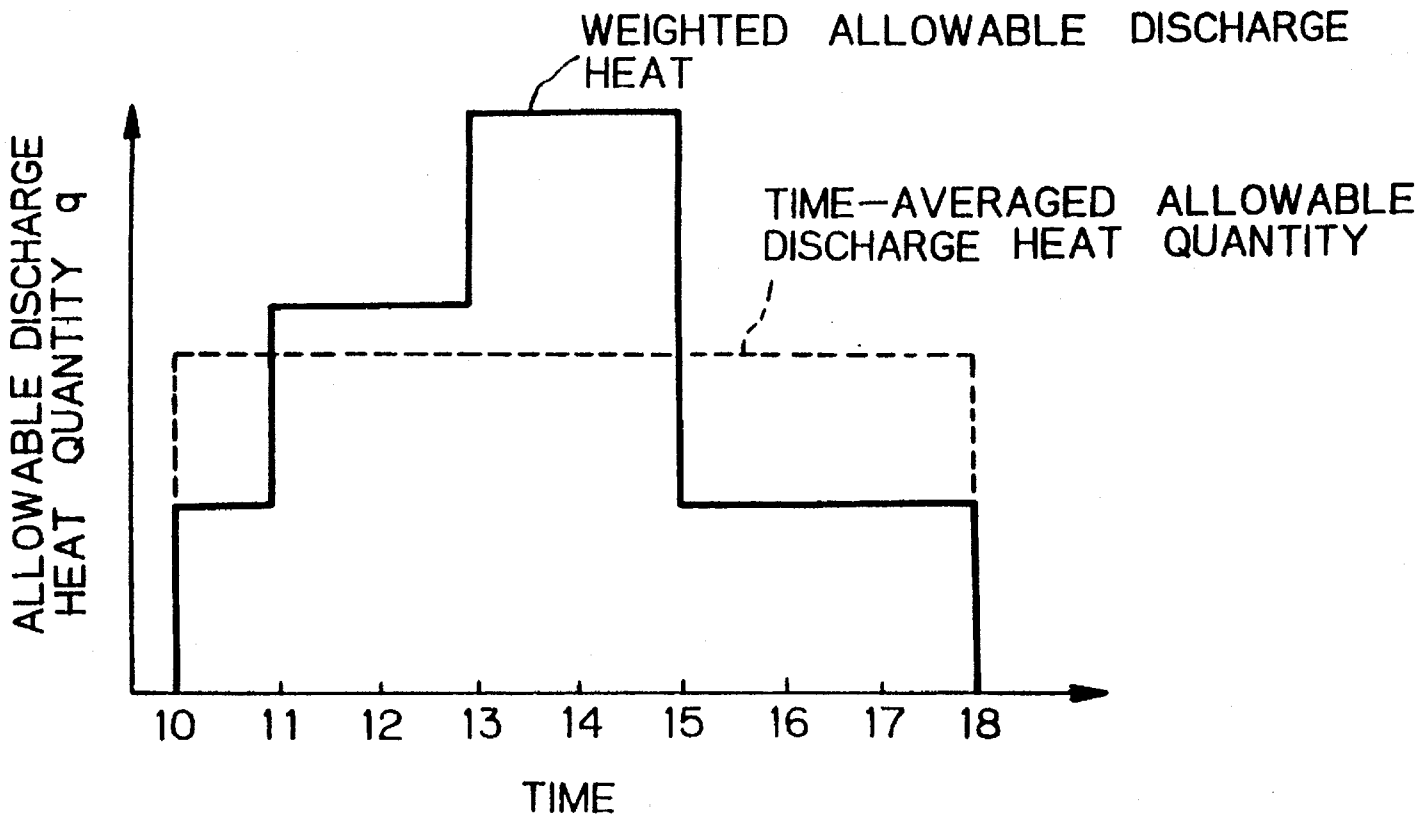
FIG. 6 is a graph showing the relationship between the remaining stored heat quantity and the allowable discharging heat quantity.

FIG. 6 is a graph showing the relationship between the operating time and the allowable discharging heat quantity of an ice thermal storage refrigerator unit. The graph shows an example of determination of an allowable discharging heat quantity at 10:00 hours. It is assumed that the operation continues to 18:00 hours.

The dotted line shows the allowable discharging heat quantity determined without being weighted. The solid line shows the allowable discharging heat quantity weighted as follows:

| | |
|---|---|
| from 8:00 hours to 11:00 hours | coefficient $\alpha = 1$ |
| from 11:00 hours to 13:00 hours | coefficient $\alpha = 2$ |
| from 13:00 hours to 15:00 hours | coefficient $\alpha = 3$ |
| from 15:00 hours to 18:00 hours | coefficient $\alpha = 1$ |

Although ice thermal storage in a cooling operation during the summer has been described above, the present invention can be similarly applied to a case where hot water is used for thermal storage in the winter. In such a case, a refrigerator is operated as a heat pump, and heat is stored to water in the ice thermal storage tank.

As has been detailed above, the present invention provides an energy-saving and low-cost ice thermal storage refrigerator unit.

What is claimed is:

1. A method for operating an ice thermal storage refrigerator unit having a brine path including a refrigerator, an ice thermal storage tank, a water heat exchanger, a brine pump, and control valves, which are connected by piping, and a cold water path including said water heat exchanger, a cooling load, and a cold water pump, which are connected by piping, so that brine is cooled in said refrigerator, and water in said ice thermal storage tank is frozen by said brine, thereby storing heat, and when heat is to be discharged, said brine is cooled by heat of fusion of the ice in said ice thermal storage tank, and said brine is introduced into said water heat exchanger to cool cold water, thereby taking out a cooling capacity, said method comprising the steps of: measuring heat content of said brine in said brine flow path for detecting a quantity of stored heat remaining in said ice thermal storage tank and for detecting a quantity of heat discharged from said ice thermal storage tank, and calculating an allowable discharging heat quantity from the quantity of stored heat remaining in said ice thermal storage tank.

2. The method according to claim 1, wherein said allowable discharging heat quantity is determined by conducting said brine measuring step at predetermined time intervals and calculating an average value of said allowable discharging heat quantity for a predetermined period of time.

3. The method according to claim 1 or claim 2, including the step of detecting the level of water in said ice thermal storage tank for detecting a quantity of stored heat remaining in said tank.

4. The method according to claim 1 or claim 2, wherein said brine heat content measuring step is conducted by a calorimeter disposed in said brine path for detecting a quantity of heat discharge from said ice thermal storage tank.

5. The method according to claim 3, wherein said brine heat content measuring step is conducted by a calorimeter disposed in said brine path for detecting a quantity of heat discharged from said thermal storage tank.

6. The method according to claim 1, wherein said allowable discharging heat quantity is determined by conducting said brine heat content measuring step at predetermined time intervals and calculating an average value based upon measured quantities weighted by the particular hours at which said measuring steps are conducted.

7. The method according to claim 1 or claim 2 wherein said brine heat content measuring step is conducted by a calorimeter disposed in said brine path for detecting a quantity of stored heat remaining in said ice thermal storage tank.

8. The method according to claim 1 or claim 2 wherein said brine heat content measuring step is conducted by sensing temperatures in said brine path at upstream and downstream sides of said ice thermal storage tank and measuring the rate of flow of brine in said brine flow path for detecting a quantity of stored heat remaining in said ice thermal storage tank.

9. The method according to claim 1 or claim 2 wherein said brine heat content measuring step is conducted by sensing temperatures in said brine path at upstream and downstream sides of said ice thermal storage tank and measuring the rate of flow of brine in said flow path for detecting a quantity of heat discharged from said ice thermal storage tank.

10. The method according to claim 7 wherein said brine heat content measuring step is conducted by a calorimeter disposed in said brine path for detecting a quantity of heat discharged from said ice thermal storage tank.

11. The method according to claim 8 wherein said brine heat content measuring step is conducted by a calorimeter disposed in said brine path for detecting a quantity of heat discharged from said ice thermal storage tank.

12. The method according to claim 3 wherein said brine heat content measuring step is conducted by sensing temperatures in said brine path at upstream and downstream sides of said ice thermal storage tank and measuring the rate of flow of brine in said brine flow path for detecting a quantity of heat discharged from said ice thermal storage tank.

13. The method according to claim 7 wherein said brine heat content measuring step is conducted by sensing temperatures in said brine path at upstream and downstream sides of said ice thermal storage tank and measuring the rate of flow of brine in said brine flow path for detecting a quantity of heat discharged from said ice thermal storage tank.

14. The method according to claim 8 wherein said brine heat content measuring step is conducted by sensing temperatures in said brine path at upstream and downstream sides of said ice thermal storage tank and measuring the rate of flow of brine in said brine flow path for detecting a quantity of heat discharged from said ice thermal storage tank.

* * * * *